US005570758A

United States Patent [19]

Nussbaum

[11] Patent Number: 5,570,758

[45] Date of Patent: Nov. 5, 1996

[54] LIFTING APPARATUS, IN PARTICULAR A LIFTING PLATFORM

[75] Inventor: Hans Nussbaum, Kehl-Sundheim, Germany

[73] Assignee: Otto Nussbaum GmbH & Co. KG, Kehl-Bodersweier

[21] Appl. No.: 362,082

[22] Filed: Dec. 21, 1994

[30] Foreign Application Priority Data

Dec. 21, 1993 [DE] Germany ..... 43 43 685.4

[51] Int. Cl.[6] ..... B66B 9/02

[52] U.S. Cl. ..... 187/268; 187/206

[58] Field of Search ..... 187/267, 268, 187/206, 203; 254/98, 93 A

[56] References Cited

U.S. PATENT DOCUMENTS

| | | | |
|---|---|---|---|
| 4,548,298 | 10/1985 | Born | 187/268 |
| 5,339,704 | 8/1994 | Lindberg | 187/268 |

FOREIGN PATENT DOCUMENTS

| | | |
|---|---|---|
| 2042643 | 3/1972 | Germany . |
| 2653012A1 | 5/1978 | Germany . |
| 2909171 | 9/1980 | Germany . |

OTHER PUBLICATIONS

A. Rastetter und E. Schmalenbach "Absturzsicherung und Haltevorrichtung für direkt–hydraulisch betriebene Aufzüge und andere Hebeeinrichtungen", *Technische Überwachung* 22, pp. 20–22, Jan. 1981.

*Primary Examiner*—Kenneth Noland
*Attorney, Agent, or Firm*—Panitch Schwarze Jacobs & Nadel, P.C.

[57] ABSTRACT

A lifting apparatus is provided, in particular a lifting platform, in which a lifting carriage, upon which the load to be lifted can be placed, can be displaced along an arrester rod which is provided with screw threading and on which there is driven by the lifting carriage an easily moveable arrester nut. The arrester nut is supported on its top and bottom by the lifting carriage in such a way that it can rotate, and in this connection the lifting carriage has a braking element which can be brought into a working relationship with the arrester nut in order to prevent any further rotation of the arrester nut. In order to improve the functioning of this arrester apparatus so that it always leads surely to a catching of the falling lifting carriage, even under particularly adverse conditions, an additional safety element is installed which can be actuated either automatically or from the outside.

14 Claims, 5 Drawing Sheets

LIFTING APPARATUS, IN PARTICULAR A LIFTING PLATFORM

FIELD OF THE INVENTION

The invention pertains to a lifting apparatus, in particular a lifting platform (e.g., an autohoist) in which a lifting carriage, upon which the load to be lifted can be placed, can be displaced along an arrester rod provided with screw threading and on which there is driven by the lifting carriage an easily movable arrester nut that is rotatably supported on its top and bottom by the lifting carriage, wherein the lifting carriage has a braking element that can be brought into a working relationship with the arrester nut in order to prevent any further rotation of the arrester nut.

BACKGROUND OF THE INVENTION

A lifting apparatus of this type is known from DE-0S 29 09 171. It functions in such a way that during normal operation, the easily movable arrester nut, a recirculating-ball nut for example, is driven upwardly and downwardly by the lifting carriage during the lifting and lowering movement, which is joined in a fixed manner with the vertically movable lifting platform, in conjunction with which the screw threading and the arrester nut are designed in such a way that no self-locking occurs.

If, for example, the chain that carries the lifting platform breaks, then instantly, as a result of the accelerated initial dropping movement of the lifting carriage, the latter comes to lie against the easily movable arrester nut, as a result of which at the same time the rotating movement of the arrester nut is prevented, and the lifting carriage is thus held securely on the arrester rod which is provided with screw threading. However, this known apparatus has the disadvantage that the braking action is not brought about until the lifting platform, and thus the lifting carriage, falls, and in conjunction with this, the stiffness of the compression spring that is placed between the lifting carriage and the arrester nut is very essential. Since the stiffness of the spring varies specifically within certain limits, the initiation of the braking effect is somewhat different as well.

SUMMARY OF THE INVENTION

It is therefore an object of the present invention to further develop this known apparatus in such a way that the braking action is not dependent upon such manufacturing tolerances and, at the same time, a higher degree of operational reliability can be attained. This object is achieved in accordance with the invention by virtue of an additional safety element for initiating the braking of the arrester nut in the apparatus. To achieve this object, in conjunction with the mechanism described above, an additional mechanism is available to prevent the falling of the lifting platform. Because of the redundancy that is present, significantly greater safety in the operation of the lifting apparatus can thus be attained.

In conjunction with this, the additional safety element can be operable from outside. In this way, an improvement in the usability of the lowering and falling brake described here is improved, since it can now be used to easily fix the lifting carriage in the raised position as well, by virtue of the fact that the safety element that is functioning as an actuator member is operated from outside, as a result of which the arresting nut is securely held in its position on the arrester rod. At the same time, however, the automatic actuation that is required of a safety apparatus can continue to be fulfilled.

In principle, the safety element can be operated electrically, electromagnetically, hydraulically, or even pneumatically. Particularly in the case of a hydraulic or pneumatic embodiment, the safety element can be acted upon by pressure in order to operate, but it can also be connected in such a way that it loses pressure in order to operate. The latter has the particular advantage that the safety element can also be integrated into the hydraulic circuit of a lifting apparatus so that in the event of a failure of the hydraulic system and the corresponding loss of pressure, the braking apparatus which is then integrated into the hydraulic circuit comes into engagement early, and an abrupt falling and catching of the lifting carriage does not take place.

Particularly in the case of a further development of the braking apparatus described above in accordance with the invention, it can, for example, be beneficial to select as the safety element and the actuating member a ring cylinder. The latter can be easily integrated into an existing hydraulic circuit, and has the advantage in addition that it is space-saving.

So that, in conjunction with this, the setting down of the braking element onto the arrester nut takes place as smoothly as possible, it is beneficial to provide in the lifting carriage a prestressed spring that automatically brings the arrester nut and the braking element into a working relationship upon operation of the actuating member. On the one hand, this can take place in such a way that the ring cylinder described above presses against the braking element via this spring.

On the other hand, however, in a preferred embodiment it is also possible for the arrester nut to be centered axially between two slightly prestressed springs, and as a result of the axial drawing back of the ring cylinder that is functioning as a safety element and an actuating member, the one spring is relaxed, so that the other spring presses the arresting nut axially against the braking element, which is configured as a surface. This has the previously mentioned advantage that the arrester apparatus continues to function in the way that was known previously, namely, that in the event the lifting carriage suddenly drops, the arrester nut, as a result of its inertia, cannot follow this movement immediately, and the braking element immediately stops it in the known manner and thus brakes and ends the fall of the lifting carriage in the known manner. At the same time, however, by means of an intentional relaxing of the one spring, the braking process can also be initiated from outside.

Along with the previously described elements, which essentially move axially, it is also possible for the safety element to be movable in an essentially radial direction relative to the arrester nut. This can be achieved with a mechanism that is simple in design. In this regard, it is for example possible to have a braking pin of the safety element engage radially in a recess in the arrester nut. The rotation of the arrester nut is stopped as a result of this, the nut no longer runs along the arrester rod, and the lifting carriage touches down with its braking element upon the previously braked arrester nut and brakes it completely because of the higher load.

With an arresting apparatus of that type, the possibility exists of having the safety element act radially as an automatically actuating braking apparatus. For this purpose, it can be mounted on the arrester nut so that as a result of the centrifugal forces arising from the rotation of the arrester nut, the safety element is displaced towards the outside, where it then comes into contact with the lifting carriage and thus brakes the arrester nut. In conjunction with this, the safety element can slide towards the outside on radial guides, whereby it constantly moves essentially parallel to the axis of the arrester nut and arrester rod.

As an alternative to this, the safety element can be designed as a single-sided lever that is supported on the arrester nut, wherein the pivot plane of the lever can be either perpendicular to the arrester nut axis or parallel to the arrester nut axis. If the pivoting plane of the lever is perpendicular to the arrester nut axis, this has the advantage that the safety element pivoting towards the outside, if the orientation is correct with respect to the rotation direction of the arrester nut, can automatically amplify the braking action as in the case of a simplex brake.

As has already been mentioned, the braking movement between the arrester nut and the safety element can be carried out by means of frictional engagement as well as by means of 10 positive engagement. In the case of a positive-engagement work relationship between the safety element and the arrester nut, in which the safety element is configured as a pin that engages in a recess, the opposite part, that is the arrester nut or the lifting carriage, can of course also have a number of recesses or depressions lying next to each other, for example in the form of internal or external gear teeth, so that the work relationship for braking of the arrester nut can be carried out in any desired angular position of the arrester nut.

In the case of a preferred embodiment of the lifting apparatus, the arrester rod is integrated into a lifting column, in particular within its hollow interior space, as a result of which the lifting column on which the load-bearing platform moves simultaneously functions as protection for the arrester rod, which is provided with screw threads, so that the arrester rod is less easily dirtied and the operational reliability of the entire safety apparatus is thus increased.

BRIEF DESCRIPTION OF THE DRAWINGS

The foregoing summary, as well as the following detailed description of preferred embodiments of the invention, will be better understood when read in conjunction with the appended drawings which show further features and advantages of the invention. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
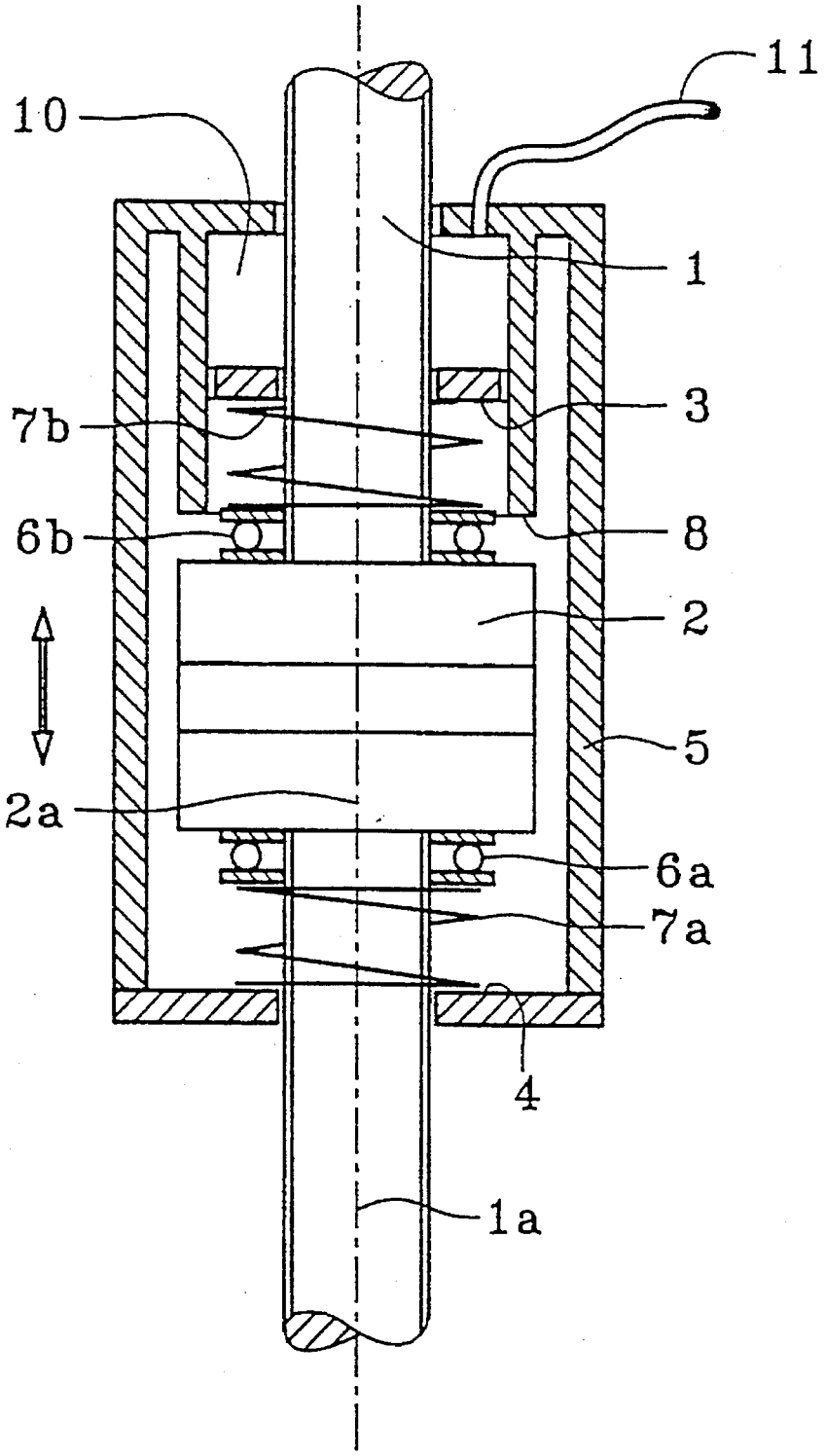
FIG. 1 is a schematic representation of an arrester apparatus, with axially arranged safety element, during normal operation.

Shown in FIG. 1 is an arresting rod 1 which is suspended by its upper end (not shown) in a lifting column of a lifting platform. This fixed arrester rod 1 is provided over its length with screw threading on which a recirculating-ball nut 2 runs, whereby the a arrester nut axis 2*a* coincides naturally with the axis 1*a* of the arrester rod. The recirculating-ball nut 2 is supported on its top and bottom by abutments 3 and 4. These abutments are part of a lifting carriage 5, which moves upwardly or downwardly in the indicated arrow directions during the lifting or the lowering of the load. The recirculating-ball nut 2 is provided on both its top and bottom with a ball bearing 6*a*, 6*b*, on which are supported compression springs 7*a* , 7*b*, which lie against the corresponding abutments 3 and 4. During the normal operation of the lifting platform, the recirculating-ball nut 2 is elastically driven by the lifting carriage 5, in that it rotates on the arrester rod 1, which is configured as a spindle.

If the lifting carriage 5 now drops as a result of a defect in the lifting platform, the lifting carriage falls faster than is the case with the usual lowering movement during normal operation in a downward direction, so that the recirculating-ball nut 2 cannot follow this accelerated initiation of the dropping movement of the lifting carriage 5. In this event, the comparatively weakly designed upper compression spring 7*b* is compressed, and the lifting carriage 5 comes to lie with its braking surface 8 on the recirculating-ball nut 2, so that the rotating movement of this arrester nut on the arrester rod 1 is prevented. In this regard, in FIGS. 1 and 2, the braking surface 8 is formed on the face of a support ring 9, which is fastened to the lifting carriage 5. As a result of the load lying on the lifting carriage 5 and thus on the braking surface 8, the lifting carriage 5 is securely held on the arrester rod 1 by the recirculating-ball nut 2, even though the screw threading of the arrester nut 2 moves easily and exhibits no self-locking.

Figure 2:
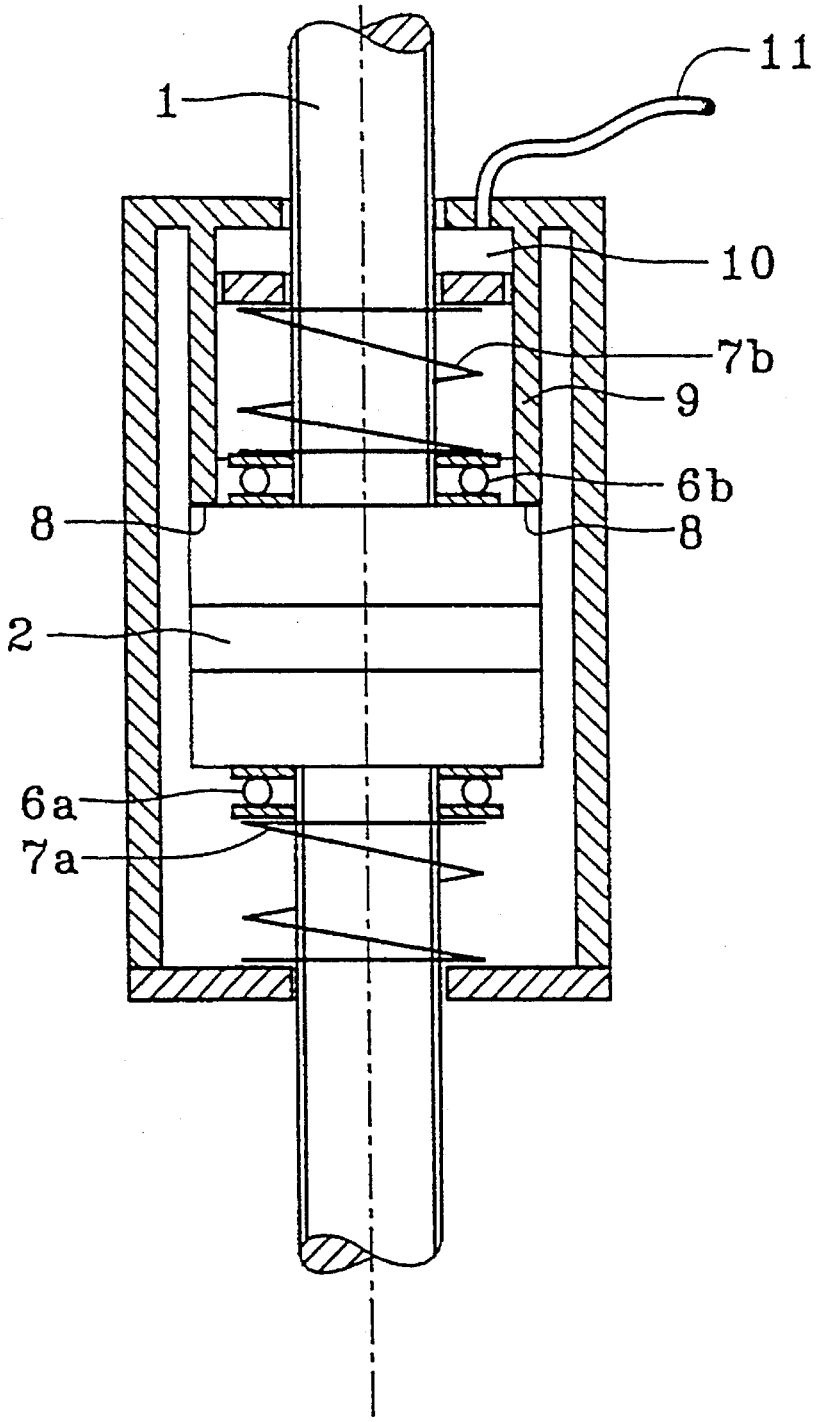
FIG. 2 is a schematic representation of the arrester apparatus, with an axially arranged safety element, during braking operation.

The arrester apparatus shown in FIGS. 1 and 2 can not only prevent a falling of the lifted load in the manner just described, but it also has an additional safety element. The abutment 3 can be displaced parallel to the arrester rod 1, which results from the fact that it is formed by the piston of a schematically represented ring cylinder 10. This ring cylinder 10 is acted upon by either hydraulic or pneumatic pressure through a line 11. As a result of this, the abutment 3 is held in a fixed position in the lifting carriage 5 by the ring cylinder 10.

By actuation of a safety valve (not shown), or as a result of the failure of the hydraulic system of the lifting platform, to which the ring cylinder 10 is connected, the pressure medium is released from the ring cylinder 10 by means of the line 11, as is shown in FIG. 2. As a result of that, first, the compression spring 7*b* is unloaded, which at the same time leads to an extension of the compression spring 7*a* that presses the recirculating-ball nut 2 upward with relation to the lifting carriage 5. With a corresponding reduction of pressure in the ring cylinder 10, the compression spring 7*a* presses the recirculating-ball nut 2 against the braking surface 8, which has as a result the braking effect on the arrester nut already described above, so that by means of a release of the pressure in the ring cylinder 10, the recirculating-ball nut 2 can be braked from the outside by 10 means of a safety actuation, whereupon the lifting carriage 5 sits firmly on the arrester rod 1.

Figure 3:
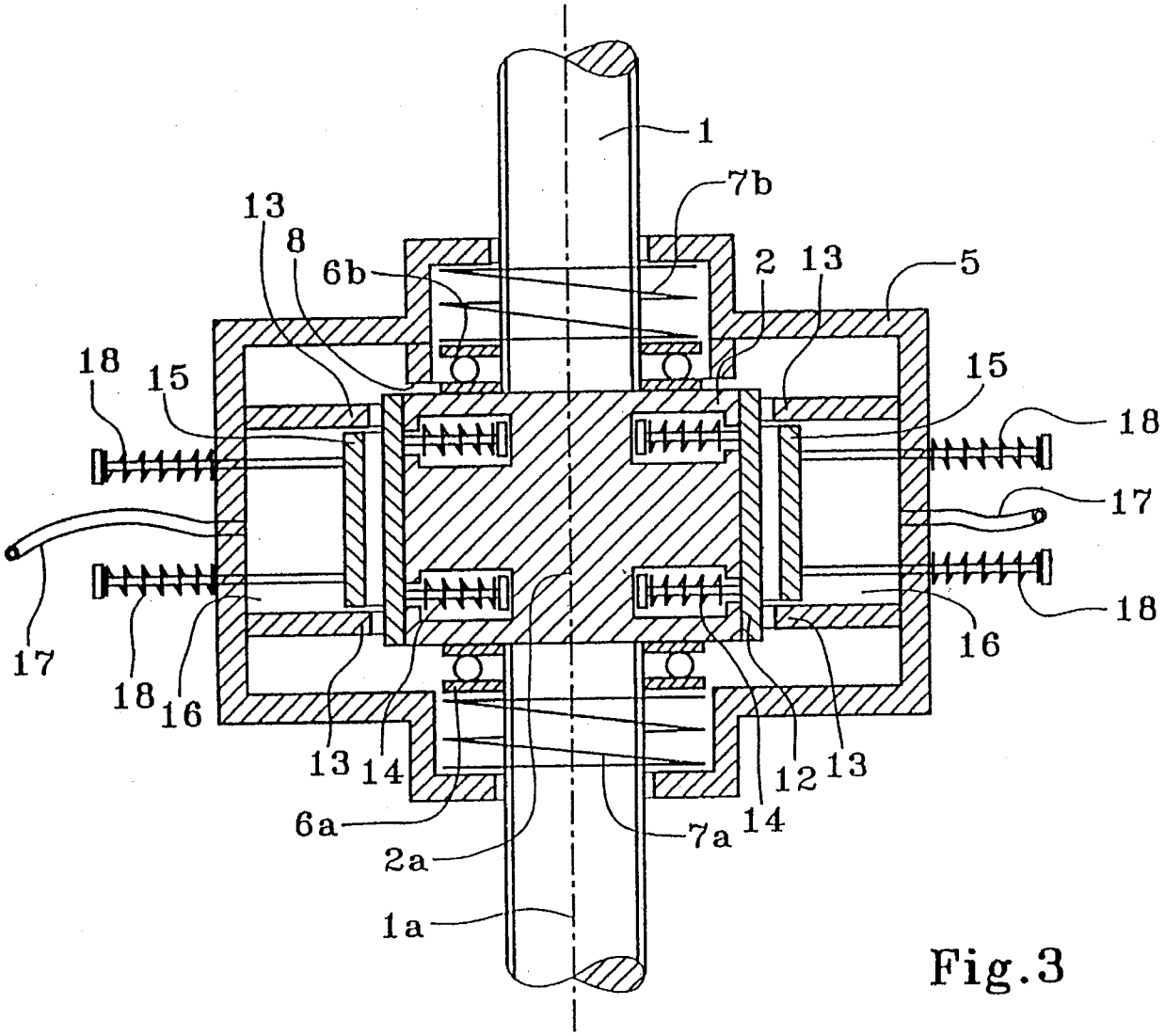
FIG. 3 is a schematic representation of an arresting apparatus, with safety elements that work radially, automatically on the one hand and able to be actuated from outside on the other.

Shown in FIG. 3 is an alternative arrangement in addition to this. Here as well, a lifting carriage 5 runs up and down on an arrester rod 1, and a recirculating-ball nut 2 follows this movement in a rotating fashion in the manner described above. In this embodiment as well, the recirculating-ball nut is supported on the lifting carriage 5 in this regard by means of corresponding ball bearings 6*a*, 6*b* and springs 7*a*, 7*b*. If the recirculating-ball nut 2 drops too quickly and rotates comparatively quickly because of the thread pitch, braking members 12 attached to it automatically move radially towards the outside because of the centrifugal forces acting upon them, and are thereby supported on braking surfaces 13 in such a way that they brake the rotating movement of the recirculating-ball nut 2. As a result, the speed of descent of the recirculating-ball nut 2 decreases, and the lifting carriage 5, which is still falling at the same speed, touches down with its braking surface 8 on the braked recirculating-ball nut 2, and brakes it fully. As a result, the further falling of the lifting carriage is prevented.

The radial extension of the braking members 12 integrated in the recirculating-ball nut 2 takes place against springs 14 that are adjusted in such a way that the lifting as a result of centrifugal force can take place only at a specific speed of rotation.

Opposite the braking members 12 are braking shoes 15, shown in FIG. 3, which can move in a direction that is essentially radial to the recirculating-ball nut 2. For this purpose, cylinder spaces 16 are to be acted upon by a pressure medium via appropriate lines 17, as a result of which the brake shoes 15 can be pressed against springs 18 onto the recirculating-ball nut 2 in order to brake the latter in the described way, so that the lifting carriage 5 again touches down with its braking surface 8 on the arrester nut, stops it completely in its rotating movement, and thus prevents the dropping of the lifting carriage 5. With that, a safety stopping of the rotation of the recirculating-ball nut 2 and thus a lowering of the lifting carriage 5 is also possible in this way under control from the outside, in that the cylinder spaces 16 are acted upon by pressure or are released from pressure from outside via the line 17. Of course, the brake shoes 15 can also be caused to brake the recirculating-ball nut 2 electrically, electromagnetically, or in a similar manner.

Figure 4:
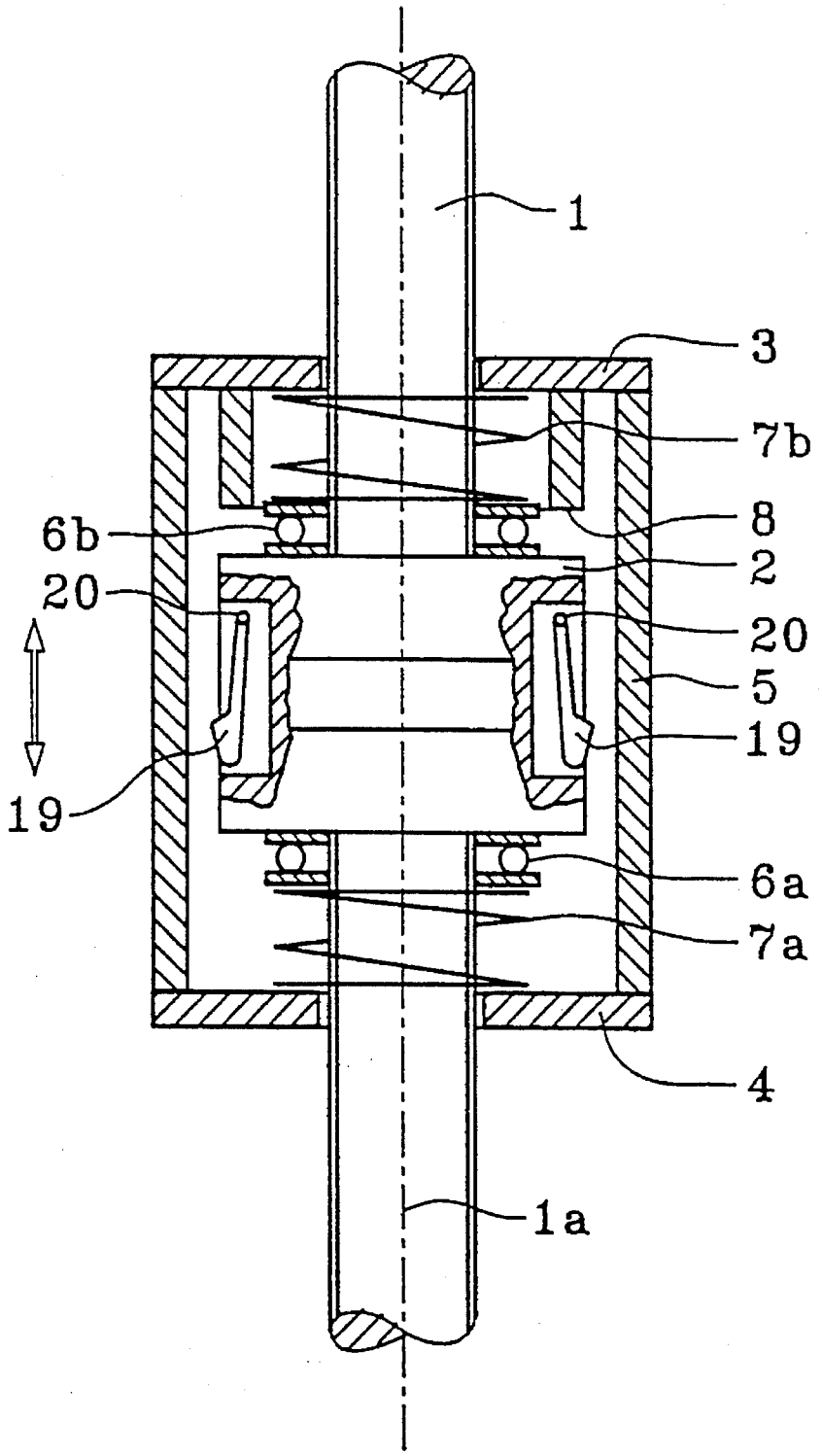
FIG. 4 is a schematic representation of an arresting apparatus, with centrifugal force levers that work radially as safety elements, in normal operation.
Figure 5:
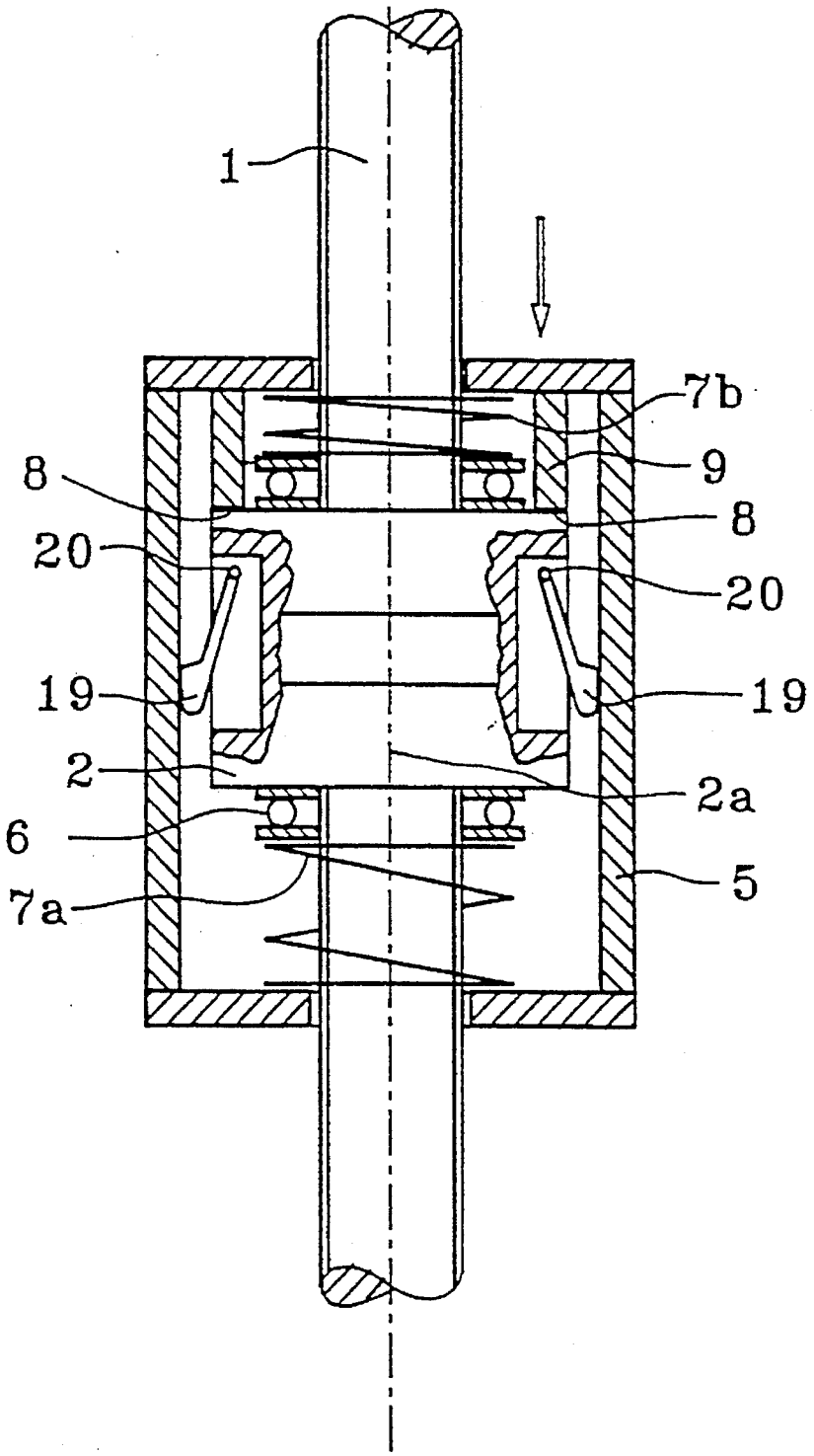
FIG. 5 is the arresting apparatus in accordance with FIG. 4, in braking operation.

Shown in FIGS. 4 and 5 is a different type of safety elements that are fastened to the arrester nut 2 and that work automatically on the basis of centrifugal force. This involves braking levers 19 that are fastened to the arrester nut 2 in a pivoting manner on axles 20. In the event of a too-rapid rotation of the arrester nut 2, these braking levers 19 pivot to the outside as a result of centrifugal force and brake the rotating arrester nut 2 on the lifting carriage 5. As a result of this, once again the speed of descent of the arrester nut 2 is decreased, and the lifting carriage 5 touches down with its braking surface 8 on the arrester nut in the known manner, brakes it to a complete stop, and thus stops the further dropping of the lifting carriage 5 in the already described manner.

In the case of the braking levers shown here, their pivoting planes lie parallel to the axis of the nut. Not shown is the possibility of having braking levers that are actuated by centrifugal force pivot in a plane perpendicular to the arrester nut axis 2*a*. In the case of a pivoting in this plane, the braking levers can, if the arrangement is correct, automatically amplify the braking of the arrester nut in the manner of a simplex brake.

Depending on the embodiment shown and the arrangement of the brakes, braking surfaces, springs, etc., it is possible to achieve with the examples shown, particularly in the case of a hydraulically actuated lifting platform, that 10 a failure of the hydraulic system leads to an automatic braking of any movement of the recirculating-ball nut, so that a special safety element is present.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A lifting apparatus, in particular a lifting platform, comprising a lifting carriage (5) upon which a load to be lifted can be placed, an arrester rod (1) along which the lifting carriage can be displaced, the arrester rod having screw threading on which an easily moveable arrester nut (2) is driven by the lifting carriage (5), the arrester nut being supported on its top and bottom by the lifting carriage (5) in such a way that it can rotate on the arrester rod, the lifting carriage having a braking element (8) which can be brought into a working relationship with the arrester nut (2) in order to prevent any further rotation of the arrester nut (2), and a safety element (10, 16, 12, 19) for initiating the braking of the arrester nut (2), the safety element (10, 16) including means for actuating the safety element from outside the lifting carriage.

2. The apparatus according to claim 1, wherein the actuating means (11, 17) transmits pressure and the safety element (10) is actuated by means of a drop in pressure.

3. The apparatus according to claim 1, wherein the actuating means (11, 17) transmits pressure and the safety element (16) is actuated by the pressure acting upon it.

4. The apparatus according to claim 1, wherein the safety element comprises a ring cylinder (10).

5. The apparatus according to claim 1, wherein the lifting carriage (5) further includes a prestressed spring (7*a*) that brings the arrester nut (2) and the braking element (8) into a working relationship when the safety element (10) is actuated.

6. The apparatus according to claim 1, wherein the safety element (12, 16, 19) is movable essentially radially to the arrester nut (2).

7. A lifting apparatus, in particular a lifting platform, comprising a lifting carriage (5) upon which a load to be lifted can be placed, an arrester rod (1) along which the lifting carriage can be displaced, the arrester rod having screw threading on which an easily moveable arrester nut (2) is driven by the lifting carriage (5), the arrester nut being supported on its top and bottom by the lifting carriage (5) in such a way that it can rotate on the arrester rod, the lifting carriage having a braking element (8) which can be brought into a working relationship with the arrester nut (2) in order to prevent any further rotation of the arrester nut (2), and a safety element (12, 19) for initiating the braking of the arrester nut (2), the safety element (12, 19) being movable essentially radially to the arrester nut (2), being fastened to the arrester nut (2) and being displacable towards the outside by means of centrifugal forces, whereby during braking of the arrester nut (2), the safety element comes into contact with the lifting carriage (5).

8. The apparatus according to claim 7, wherein the safety element is configured as a lever (19) carried on one side of the arrester nut (2).

9. The apparatus according to claim 8, wherein the pivoting plane of the lever (19) is parallel to a longitudinal axis (2*a*) of the arrester nut.

10. The apparatus according to claim 7, wherein the safety element (12) slides towards the outside on radial guides.

11. The apparatus according to claim 7, wherein the safety element (12) is drawn into its rest position by means of a spring (14).

12. A lifting apparatus, in particular a lifting platform, comprising a lifting carriage (5) upon which a load to be lifted can be placed, an arrester rod (1) along which the lifting carriage can be displaced, the arrester rod having screw threading on which an easily moveable arrester nut (2) is driven by the lifting carriage (5), the arrester nut being supported on its top and bottom by the lifting carriage (5) in such a way that it can rotate on the arrester rod, the lifting carriage having a braking element (8) which can be brought into a working relationship with the arrester nut (2) in order to prevent any further rotation of the arrester nut (2), and a safety element (10, 16, 12, 19) for initiating the braking of the arrester nut (2), the lifting carriage (5) further including a prestressed spring (*7a*) that brings the arrester nut 92) and the braking element (8) into a working relationship when the safety element (10) is actuates, the arrester nut (20 being axially centered between two slightly prestressed springs (*7a*, *7b*), and by means of the safety element (10), the one spring (*7b*) being relaxed and the other spring (*7a*) pressing the arrester nut (2) axially against the braking element (8), which is configured as a surface.

13. A lifting apparatus, in particular a lifting platform, comprising a lifting carriage (5) upon which a load to be lifted can be placed, an arrester rod (1) along which the lifting carriage can be displaced, the arrester rod having screw threading on which an easily moveable arrester nut (2) is driven by the lifting carriage (5), the arrester nut being supported on its top and bottom by the lifting carriage (5) in such a way that it can rotate on the arrester rod, the lifting carriage having a braking element (8) which can be brought into a working relationship with the arrester nut (2) in order to prevent any further rotation of the arrester nut (2), and a safety element (10, 16, 12, 19) for initiating the braking of the arrester nut (2), the safety element (12, 16, 19) being movable essentially radially to the arrester nut (2), and comprising a braking pin which engages in a recess on the arrester nut.

14. A lifting apparatus, in particular a lifting platform, comprising a lifting carriage (5) upon which a load to be lifted can be placed, an arrester rod (1) along which the lifting carriage can be displaced, the arrester rod having screw threading on which an easily moveable arrester nut (2) is driven by the lifting carriage (5), the arrester nut being supported on its top and bottom by the lifting carriage (5) in such way that it can rotate on the arrester rod, the lifting carriage having a braking element (8) which can be brought into a working relationship with the arrester nut (2) in order to prevent any further rotation of the arrester nut (2), and a safety element (10, 16, 12, 19) for initiating the braking of the arrester nut (2), the lifting apparatus having a lifting column in which the arrester rod 91) is integrated, the arrester rod being arranged in a hollow interior of the lifting column.

* * * * *